US007186159B1

(12) United States Patent
Baxter

(10) Patent No.: US 7,186,159 B1
(45) Date of Patent: Mar. 6, 2007

(54) SPORTS HEADGEAR APPARATUS

(76) Inventor: Donald W. Baxter, 28112 Palmao, Mission Viejo, CA (US) 92692

( * ) Notice: Subject to any disclaimer, the term of this patent is extended or adjusted under 35 U.S.C. 154(b) by 0 days.

(21) Appl. No.: 11/337,057

(22) Filed: Jan. 23, 2006

(51) Int. Cl.
*B63C 9/08* (2006.01)
*A42B 1/08* (2006.01)

(52) U.S. Cl. ..... 441/124; 2/422

(58) Field of Classification Search ..... 441/124; 2/68, 422

See application file for complete search history.

(56) References Cited

U.S. PATENT DOCUMENTS 4,281,417 A * 8/1981 Valentine ..... 2/68
4,729,132 A 3/1988 Fierro
5,129,107 A 7/1992 Lorenzo
5,915,537 A 6/1999 Dallas et al.
6,009,563 A 1/2000 Swanson et al.
6,028,627 A 2/2000 Helmsderfer
6,105,167 A * 8/2000 Wong ..... 2/68
6,546,264 B1 4/2003 Kennedy

FOREIGN PATENT DOCUMENTS

DE 2848066 A * 5/1980

* cited by examiner

*Primary Examiner*—Jesús D. Sotelo

(57) ABSTRACT

A sports headgear apparatus includes a head covering that has a concave inner surface and a convex outer surface. The head covering comprises a panel that has a substantially semi-spherical shape. The panel has a bottom perimeter edge defining an opening into the head covering. A perimeter tube is attached to and is coextensive with the bottom perimeter edge. The tube is substantially airtight. A canister having compressed air therein is fluidly coupled to the tube. A pressure sensitive valve is fluidly coupled to the to canister and opening the canister when the pressure sensitive valve detects a predetermined water depth.

15 Claims, 4 Drawing Sheets

SPORTS HEADGEAR APPARATUS

BACKGROUND OF THE INVENTION

1. Field of the Invention

The present invention relates to sports headgear devices and more particularly pertains to a new sports headgear device for positioning on a person's head while that person is in the water to aid the person in rising to the surface should they go too far under the water.

2. Description of the Prior Art

The use of sports headgear devices is known in the prior art. While these devices fulfill their respective, particular objectives and requirements, the need remains for a device for persons who are in water that can assist the person in rising to the surface of the water if they have become injured and are sinking below a predetermined depth. Further, the device should include locating and communication means between the person wearing the device and a remotely positioned receiver.

SUMMARY OF THE INVENTION

The present invention meets the needs presented above by generally comprising a head covering that has a concave inner surface and a convex outer surface. The head covering comprises a panel that has a substantially semi-spherical shape. The panel is comprised of a resiliently stretchable material and has a bottom perimeter edge defining an opening into the head covering. A perimeter tube is attached to and is coextensive with the bottom perimeter edge. The tube is substantially airtight. A canister having compressed air therein is fluidly coupled to the tube. A pressure sensitive valve is fluidly coupled to the to canister and opening the canister when the pressure sensitive valve detects a predetermined water depth.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
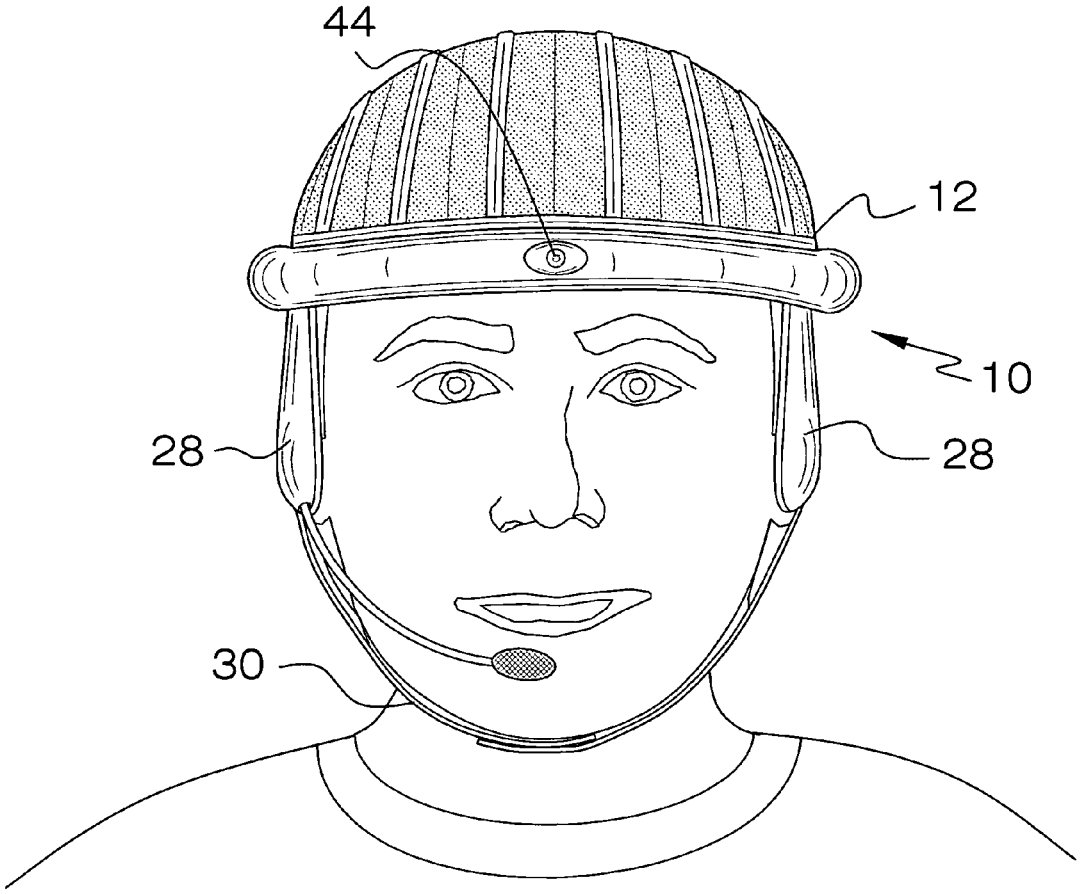
FIG. 1 is a front in-use view of a sports headgear apparatus according to the present invention.
Figure 2:
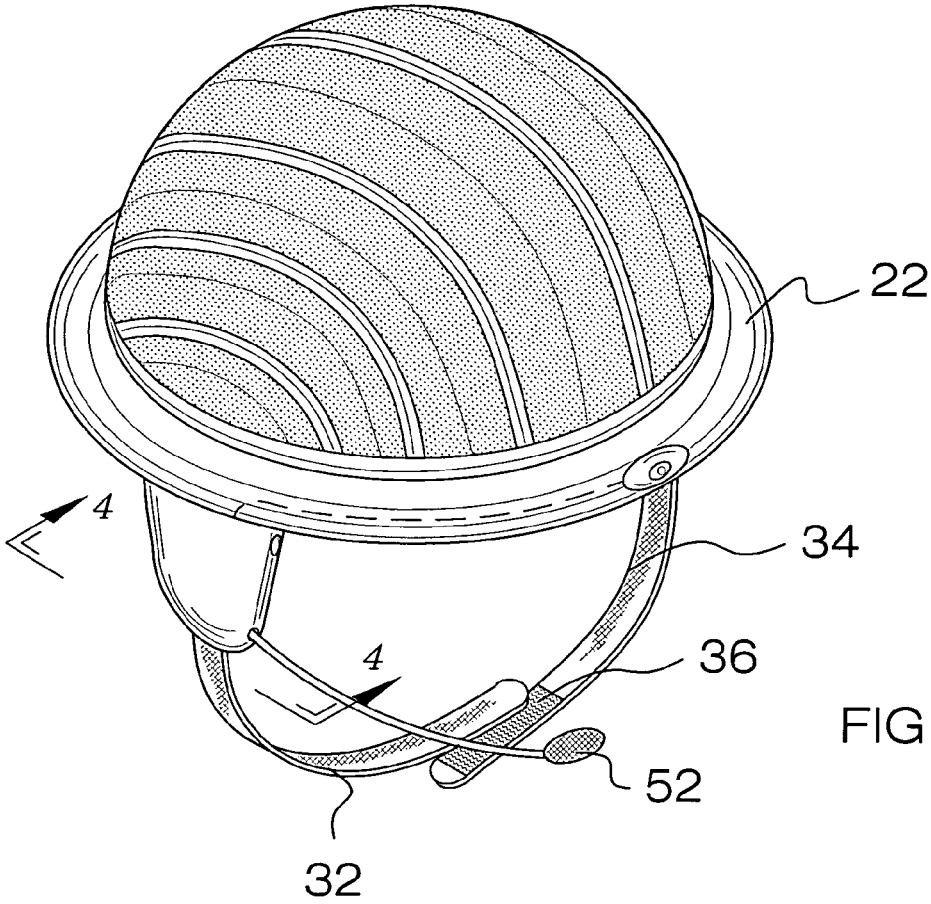
FIG. 2 is a perspective front view of the present invention.
Figure 3:
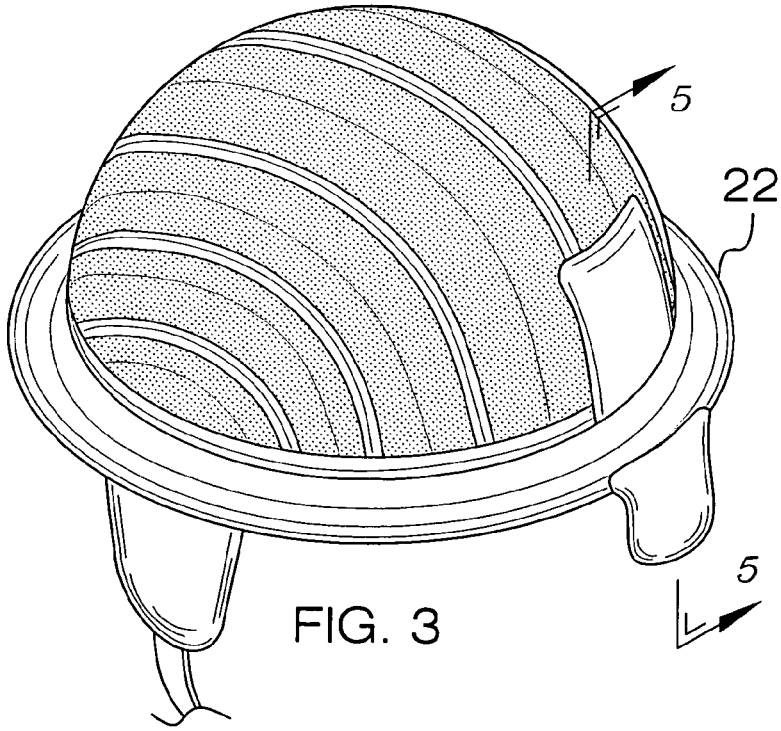
FIG. 3 is a perspective rear view of the present invention.
Figure 4:
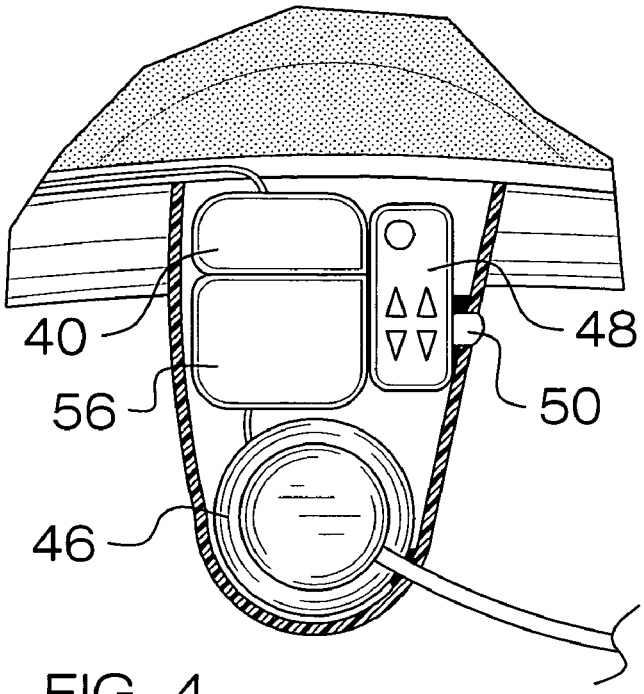
FIG. 4 is a cross-sectional view taken alone line 4—4 of FIG. 2 of the present invention.
Figure 5:
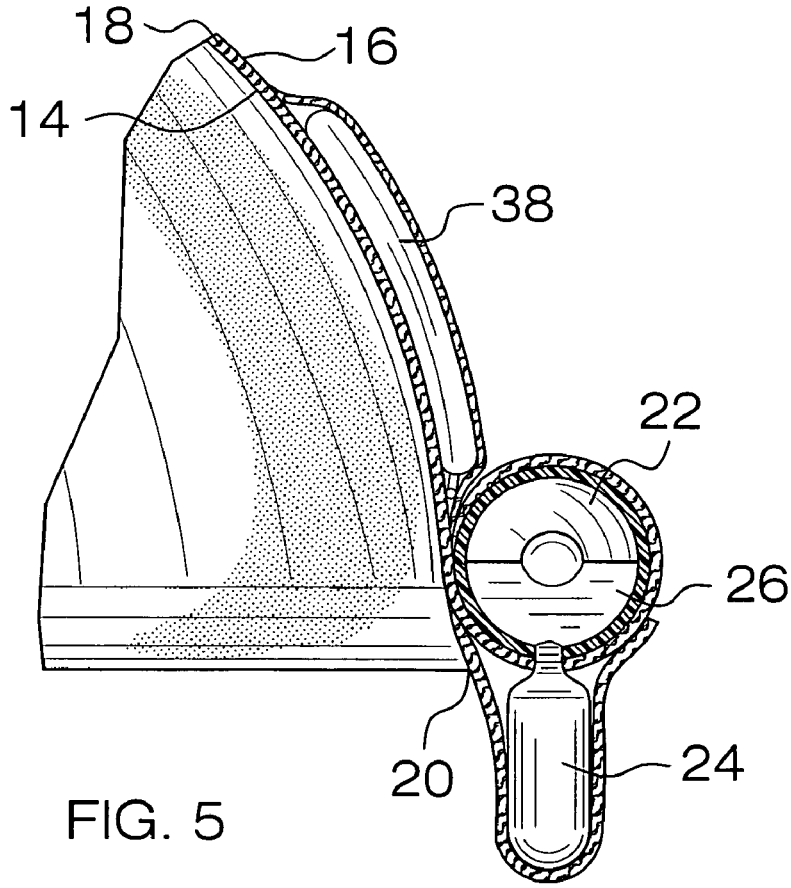
FIG. 5 is a cross-sectional view taken along line 5—5 of FIG. 3 of the present invention.
Figure 6:
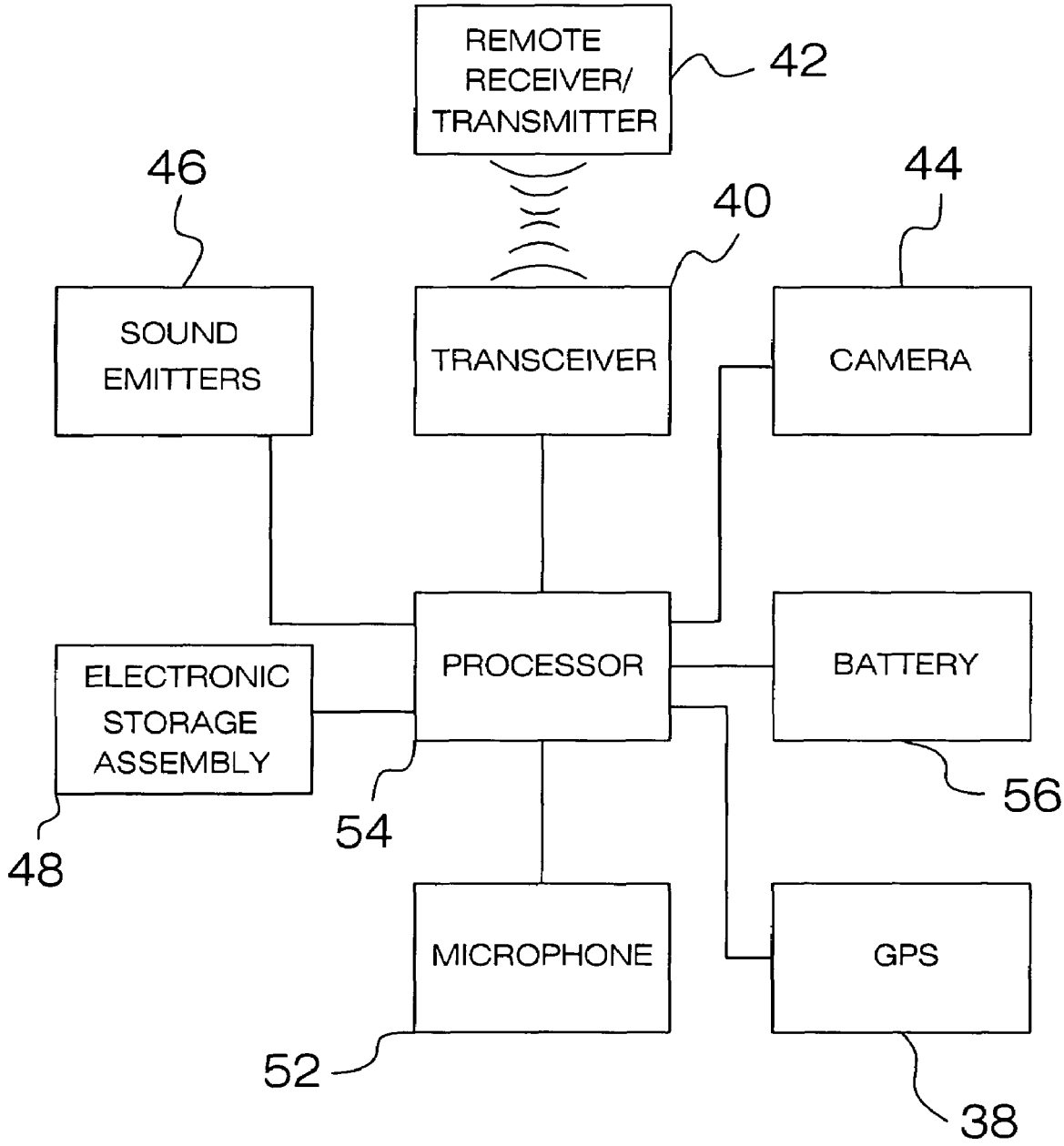
FIG. 6 is an electronic schematic view of the present invention.

With reference now to the drawings, and in particular to FIGS. 1 through 6 thereof, a new sports headgear device embodying the principles and concepts of the present invention and generally designated by the reference numeral 10 will be described.

As best illustrated in FIGS. 1 through 6, the sports headgear apparatus 10 generally comprises a head covering 12 having a concave inner surface 14 and a convex outer surface 16. The head covering 12 comprises a panel 18 having a substantially semi-spherical shape. The panel 18 is comprised of a resiliently stretchable material and has a bottom perimeter edge 20 defining an opening into the head covering 12.

A perimeter tube 22 is attached to and is coextensive with the bottom perimeter edge 20. The tube 22 is substantially airtight. A canister 24 having compressed air therein is fluidly coupled to the tube 22. A pressure sensitive valve 26 is fluidly coupled to the to canister 24 and opens the canister 24 when the pressure sensitive valve detects a predetermined water depth so that the tube 22 is filled with air and the head covering 12 becomes buoyant. The predetermined water depth is between 10 feet and 100 feet.

A pair of ear coverings 28 is provided. Each of the ear coverings 28 is attached to the bottom perimeter edge 20 and is positioned opposite of each other. A strap 30 is attached to and extends between the ear coverings 28. The strap 30 has a break therein and a first portion 32 and a second portion 34 of the strap 30 are defined. The first 32 and second 34 portions are removably attached together with a hook and loop coupler 36.

A global positioning tracking unit 38 is positioned in the head covering 12. A transceiver 40 is electrically coupled to the global positioning tracking unit 38 and is configured to transmit a position of the head covering 12 to a remote receiver 42 and to receive sound signals from the remote receiver 42. A camera 44 is mounted to the head covering 12 and is directed forward of the head covering 12. The camera 44 is electrically coupled to the transceiver 40. The transceiver 40 transmits images captured by the camera 44 to the remote receiver 42.

A pair of sound emitters 46 is provided. Each of the sound emitters 46 is positioned in one of the ear coverings 28. The sound emitters 28 are electrically coupled to the transceiver 40 and emit sounds received as sound signals from the transceiver 40. These sound signals may be sent by the remote receiver 42, which preferably includes a transmitter.

An electronic storage assembly 48 configured for electrically storing sound files using conventional electronic memory is mounted in one of the ear coverings 28 and is electrically coupled to the sound emitters 46. A jack 50 is electrically coupled to the electronic storage assembly 48 for allowing sound files to be downloaded to the electronic storage assembly 48. The sound emitters 46 emit sounds from the sound files when the electronic storage assembly 48 is turned on. A microphone 52 is attached to the head covering 12 and is electronically coupled to the transceiver 40. The transceiver 40 transmits sounds captured by the microphone 52 to the remote receiver. Each of the electronic storage assembly 48, sound emitters 46, transceiver 40 and camera 44 may be integrated together with a conventional processor 54 powered by a rechargeable battery 56.

In use, the head covering 12 is worn as shown in FIG. 1 by a person in the water. The tube 22 inflates if the person goes below a certain depth to help bring the person to the surface of the water. The remote receiver 42 allows a second person to track the head covering 12 and to see, via the camera 44, what is in front of the person wearing the head covering 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A headgear apparatus configured for positioning on a person's head while the person is in water, said apparatus comprising:

a head covering having a concave inner surface and a convex outer surface, said head covering comprising a panel having a substantially semi-spherical shape, said panel being comprised of a resiliently stretchable material, said panel having a bottom perimeter edge defining an opening into said head covering;

a perimeter tube being attached to and being coextensive with said bottom perimeter edge, said tube being substantially airtight, a canister having compressed air therein being fluidly coupled to said tube, a pressure sensitive valve being fluidly coupled to said to canister and opening said canister when said pressure sensitive valve detects a predetermined water depth; and a pair of ear coverings, each of said ear coverings being attached to said bottom perimeter edge and being positioned opposite of each other; and a global positioning tracking unit being positioned in said head covering, a transceiver being electrically coupled to said global positioning tracking unit and being configured to transmit a position of said head covering to a remote receiver.

2. The apparatus according to claim 1, further including a strap being attached to and extending between said ear coverings, said strap having a break therein and a first portion and a second portion of said strap is defined, said first and second portions being removably attached together.

3. The apparatus according to claim 1, further including a camera being mounted to said head covering and being directed forward of said head covering, said camera being electrically coupled to said transceiver, wherein said transceiver transmits images captured by said camera to the remote receiver.

4. The apparatus according to claim 1, wherein said transceiver is further configured to receive sound signals from the remote receiver, said apparatus further including a pair of sound emitters, each of said sound emitters being positioned in one of said ear coverings, said sound emitters being electrically coupled to said transceiver, said sound emitters emitting sounds received as sound signals from said transceiver.

5. The apparatus according to claim 4, further including an electronic storage assembly configured for electrically storing sound files being mounted in one of said ear coverings and being electrically coupled to said sound emitters, said sound emitters emitting sounds from said sound files when said electronic storage assembly is turned on.

6. The apparatus according to claim 1, further including a microphone being attached to said head covering and being electronically coupled to said transceiver, wherein said transceiver transmits sounds captured by said microphone to the remote receiver.

7. A headgear apparatus configured for positioning on a person's head while the person is in water, said apparatus comprising:

a head covering having a concave inner surface and a convex outer surface, said head covering comprising a panel having a substantially semi-spherical shape, said panel being comprised of a resiliently stretchable material, said panel having a bottom perimeter edge defining an opening into said head covering;

a perimeter tube being attached to and being coextensive with said bottom perimeter edge, said tube being substantially airtight, a canister having compressed air therein being fluidly coupled to said tube, a pressure sensitive valve being fluidly coupled to said to canister and opening said canister when said pressure sensitive valve detects a predetermined water depth, said predetermined water depth being between 10 feet and 100 feet;

a pair of ear coverings, each of said ear coverings being attached to said bottom perimeter edge and being positioned opposite of each other;

a strap being attached to and extending between said ear coverings, said strap having a break therein and a first portion and a second portion of said strap is defined, said first and second portions being removably attached together with a hook and loop coupler;

a global positioning tracking unit being positioned in said head covering;

a transceiver being electrically coupled to said global positioning tracking unit and being configured to transmit a position of said head covering to a remote receiver and to receive sound signals from the remote receiver;

a camera being mounted to said head covering and being directed forward of said head covering, said camera being electrically coupled to said transceiver, wherein said transceiver transmits images captured by said camera to the remote receiver;

a pair of sound emitters, each of said sound emitters being positioned in one of said ear coverings, said sound emitters being electrically coupled to said transceiver, said sound emitters emitting sounds received as sound signals from said transceiver;

an electronic storage assembly configured for electrically storing sound files being mounted in one of said ear coverings and being electrically coupled to said sound emitters, said sound emitters emitting sounds from said sound files when said electronic storage assembly is turned on; and a microphone being attached to said head covering and being electronically coupled to said transceiver, wherein said transceiver transmits sounds captured by said microphone to the remote receiver.

8. A headgear apparatus configured for positioning on a person's head while the person is in water, said apparatus comprising:

a head covering having a concave inner surface and a convex outer surface, said head covering comprising a panel having a substantially semi-spherical shape, said panel being comprised of a resiliently stretchable material, said panel having a bottom perimeter edge defining an opening into said head covering; and a perimeter tube being attached to and being coextensive with said bottom perimeter edge, said tube being substantially airtight, a canister having compressed air therein being fluidly coupled to said tube, a pressure sensitive valve being fluidly coupled to said to canister and opening said canister when said pressure sensitive valve detects a predetermined water depth; and a camera being mounted to said head covering and being directed forward of said head covering, said camera being electrically coupled to said transceiver, wherein said transceiver transmits images captured by said camera to the remote receiver;

a transceiver configured to transmit a wireless signal to a remote receiver; and a global positioning tracking unit being positioned in said head covering, a transceiver being electrically coupled to said global positioning tracking unit and being configured to transmit a position of said head covering to a remote receiver.

9. The apparatus according to claim 8, further including a pair of ear coverings, each of said ear coverings being attached to said bottom perimeter edge and being positioned opposite of each other.

10. The apparatus according to claim 9, further including a strap being attached to and extending between said ear coverings, said strap having a break therein and a first portion and a second portion of said strap is defined, said first and second portions being removably attached together.

11. The apparatus according to claim 9, wherein said transceiver is further configured to receive sound signals from the remote receiver, said apparatus further including a pair of sound emitters, each of said sound emitters being positioned in one of said ear coverings, said sound emitters being electrically coupled to said transceiver, said sound emitters emitting sounds received as sound signals from said transceiver.

12. The apparatus according to claim 11, further including an electronic storage assembly configured for electrically storing sound files being mounted in one of said ear coverings and being electrically coupled to said sound emitters, said sound emitters emitting sounds from said sound files when said electronic storage assembly is turned on.

13. The apparatus according to claim 11, further including a microphone being attached to said head covering and being electronically coupled to said transceiver, wherein said transceiver transmits sounds captured by said microphone to the remote receiver.

14. The apparatus according to claim 8, further including a microphone being attached to said head covering and being electronically coupled to said transceiver, wherein said transceiver transmits sounds captured by said microphone to the remote receiver.

15. The apparatus according to claim 8, further including a global positioning tracking unit being positioned in said head covering, said transceiver being electrically coupled to said global positioning tracking unit.

* * * * *